US006547700B2

(12) United States Patent
Tu

(10) Patent No.: US 6,547,700 B2
(45) Date of Patent: Apr. 15, 2003

(54) NEURO-FUZZY EXERCISER INSTRUMENT PANEL

(76) Inventor: Hsuzh-Ho Tu, No. 8, Lane 8, Te Wei Street, U Feng Hsian, Taichung Hsien (TW)

( * ) Notice: Subject to any disclaimer, the term of this patent is extended or adjusted under 35 U.S.C. 154(b) by 41 days.

(21) Appl. No.: 09/824,633

(22) Filed: Apr. 4, 2001

(65) Prior Publication Data

US 2002/0147073 A1 Oct. 10, 2002

(51) Int. Cl.[7] ..... A61H 23/02
(52) U.S. Cl. ..... 482/1; 601/23; 601/26
(58) Field of Search ..... 482/1–9, 900, 482/901; 601/23, 24, 26, 33–36, 46–54, 56, 84–87; 318/16

(56) References Cited

U.S. PATENT DOCUMENTS 6,120,468 A * 9/2000 Tseng ..... 601/46
6,375,630 B1 * 4/2002 Cutler et al. ..... 601/57
6,396,224 B1 * 5/2002 Luff et al. ..... 318/16

* cited by examiner

*Primary Examiner*—Glenn E. Richman
(74) *Attorney, Agent, or Firm*—Browdy and Neimark, P.L.L.C.

(57) ABSTRACT

A neuro-fuzzy exerciser instrument panel installed in an exerciser, including a housing, a main control circuit, a set of control buttons, a massager unit, the massager unit having energy generating means adapted to generate an energy for stimulating the muscles of the user and at least one massaging device adapted to transmit the energy from the energy generating means to a part of the body of the user, switch means adapted to switch on/off the massager unit; and power source means adapted to provide the necessary working voltage to the main control circuit and the massager unit.

8 Claims, 4 Drawing Sheets

NEURO-FUZZY EXERCISER INSTRUMENT PANEL

BACKGROUND OF THE INVENTION

The present invention relates to exercising machines and, more specifically, to a neuro-fuzzy exerciser instrument panel, which controls the operation of the exerciser and, provides an energy to the body of the user to stimulate the muscles and the circulation of blood.

Due to limited spaces and times, people usually use exercising machines (such as stationary bicycle, rowing machine, stepping exerciser, and etc.) to exercise the body physically. Regular exercising machines are commonly equipped with an instrument panel, which shows the data of operation status (time, load, velocity). There is known instrument panels for exercising machines that have a particular physical condition measuring means adapted to measure a particular function of the body (for example, heart beat, flood pressure, or body fat). However, these instrument panels provide only a particular physical data of the body of the user for reference. They do ho help to improve the physical condition of the body of the user.

Further, after an exercise with an exercising machine, the muscles may ache. Physically, the occurrence of such muscle ache is due to an accumulation of lactate (which may cause gout). At the initial stage when starting to exercise the body, the energy required for the contraction of the muscles of the body is obtained from the decomposing of ATP (adenosine triphosphate) and CP (phosphocreatine). However, this every meets the demand for few seconds only. Thereafter, the required energy is obtained from the non-oxygen metabolism of glycogen. However, the non-oxygen metabolism of glycogen results in an accumulation of lactate. The aforesaid conventional instrument panels cannot eliminate the problem of muscle ache.

SUMMARY OF THE INVENTION

The present invention has been accomplished under the circumstances in view. It is the main object of the present invention to provide a neuro-fuzzy exerciser instrument panel, which has means to relax the muscles and stimulate the circulation of blood. The neuro-fuzzy exerciser instrument panel of the invention is installed in an exerciser, comprising a housing, a main control circuit, a set of control buttons, a massager unit, the massager unit having energy generating means adapted to generate an energy for stimulating the muscles of the user and at least one massaging device adapted to transmit the energy from the energy generating means to a part of the body of the user, switch means adapted to switch on/off the massager unit; and power source means adapted to provide the necessary working voltage to the main control circuit and the massager unit.

DETAILED DESCRIPTION OF THE PREFERRED EMBODIMENT

Figure 1:
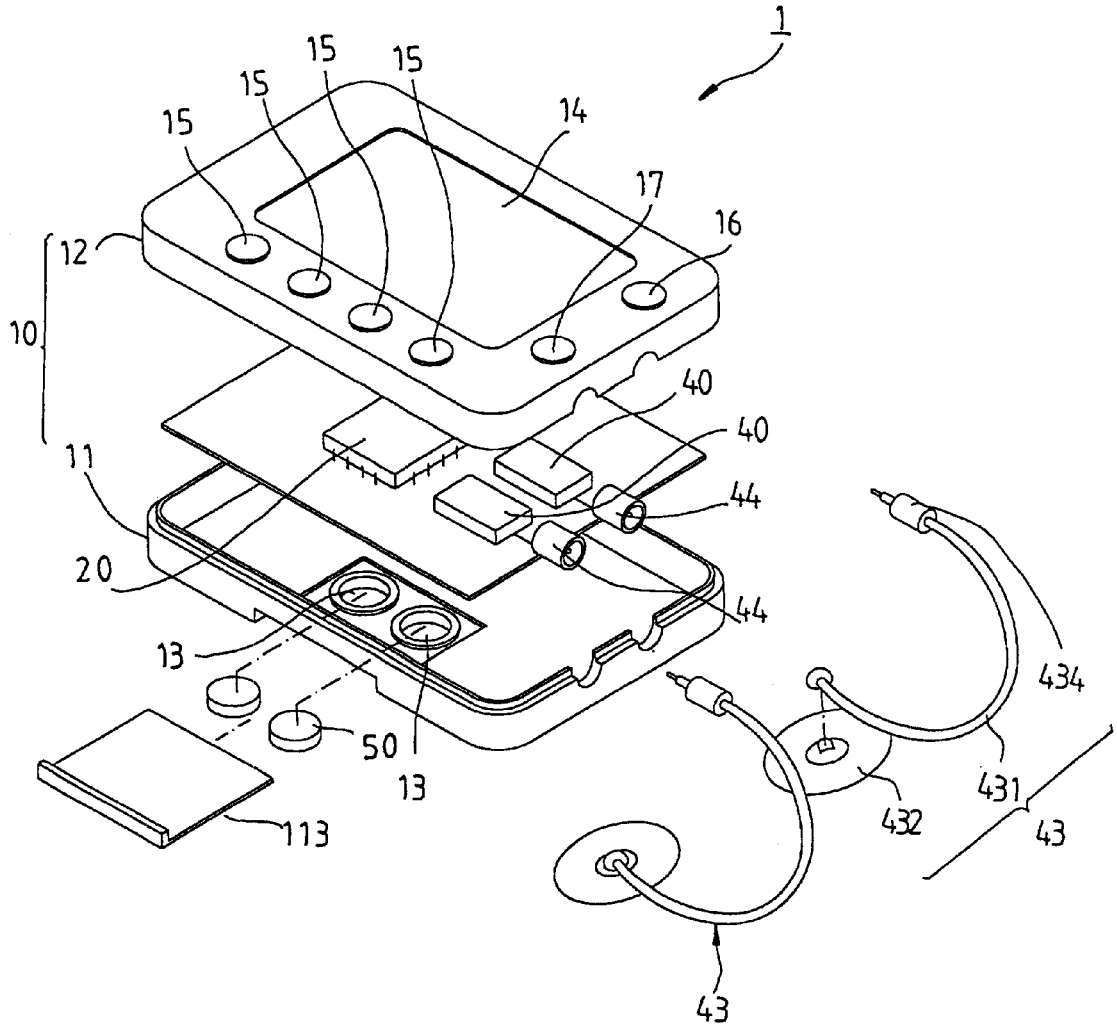
FIG. 1 is an exploded view of a neuro-fuzzy exerciser instrument panel according to the present invention.
Figure 2:
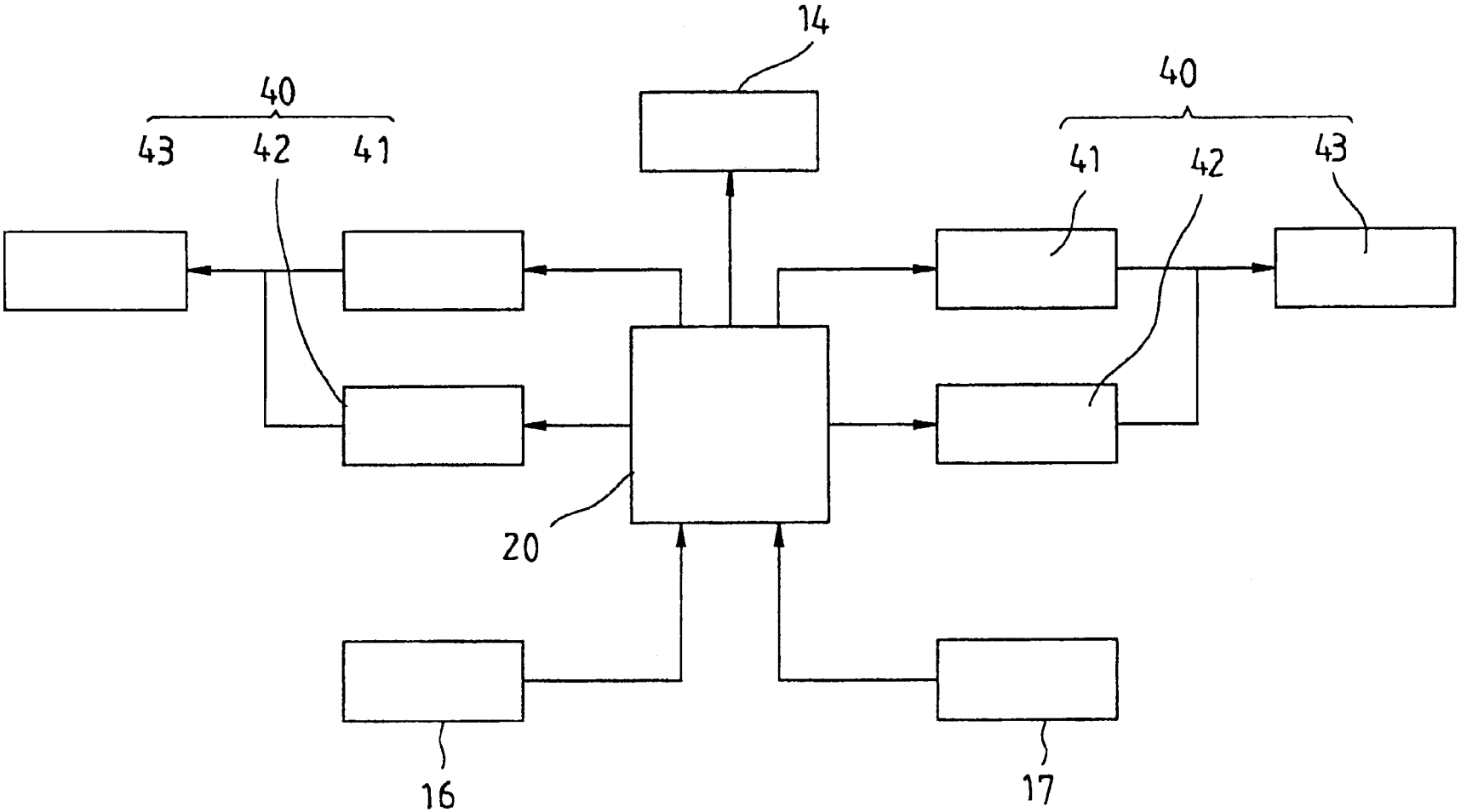
FIG. 2 is a control mode block diagram according to the present invention.

Referring to FIG. 1, a neuro-fuzzy exerciser instrument panel 1 is shown comprised of a housing 10, a control circuit 20, a massager unit 40, and a power source 50.

Figure 3:
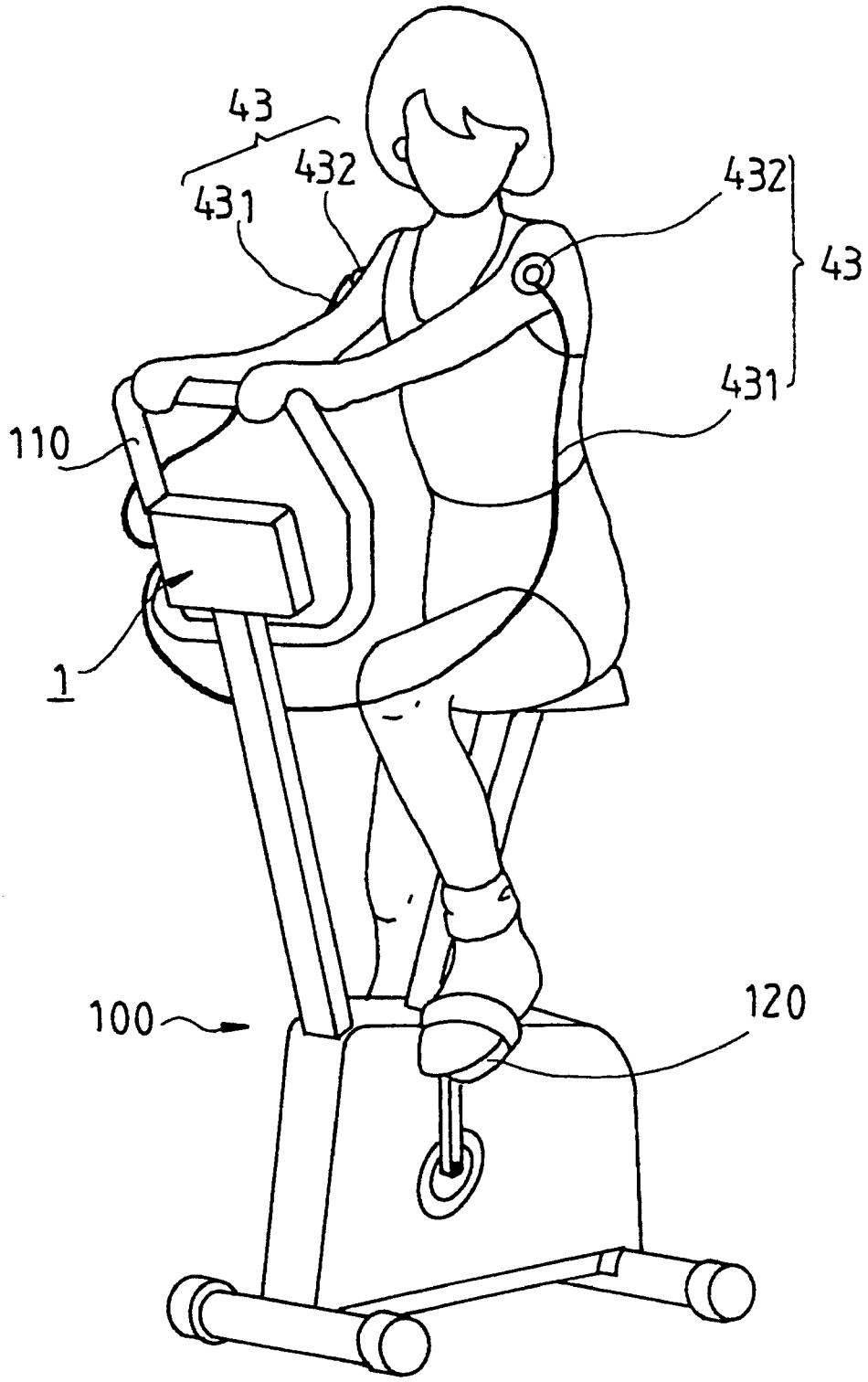
FIG. 3 is an applied view of the present invention.

The housing 10 is installed in an exerciser at a suitable location (for example, at the handle 110 of a stationary bicycle 100, as shown in FIG. 3). According to the present preferred embodiment, the housing 10 comprises a bottom shell 11 and a top cover shell 12 covered on the bottom shell 11. The bottom shell 11 comprises two battery holders 13, and a battery lid 113 covered the battery holders 13. The top cover shell 12 comprises a display screen 14, a set of control buttons 15, and two switches 16 and 17. The functions of the control buttons 15 and the switches 16 and 17 will be described further.

The control circuit 20 is installed in the housing 10, and adapted to control the operation status provided by the neuro-fuzzy exerciser instrument panel and the exerciser in which the neuro-fuzzy exerciser instrument panel is installed. The control circuit 20 runs subject to signals inputted through the control buttons 15 and the switches 16 and 17, and drives the display screen 14 to display every operation status.

The massager unit 40 provides energy to relax the muscles of the user. According to the present preferred embodiment, the massager unit 40 comprises two voltage generators 41 adapted to produce a low-frequency electric pulse, two pulse control circuit 42 adapted to control the modes (for example, the frequency, and low-to-high, high-to-low, or high/low alternative circulation) of the low-frequency electric pulse generated by the voltage generators 41, two jacks 44 respectively connected to the voltage generators 41 for the output of the low-frequency electric pulse generated by the voltage generators 41, and two massaging devices 43 adapted to transmit the low-frequency electric pulse of the voltage generators 41 from the jacks 44 to the body of the user. The aforesaid control circuit 20 controls the voltage generators 41 and the pulse control circuit 42. The aforesaid second switch 17 and the control buttons 15 control the on/off status and the modes of the low-frequency electric pulse generated by the voltage generators 41. The massaging devices 43 each comprise a conductor 431, a flexible, electrically conductive rubber pad 432 detachably coupled to the periphery of one end of the conductor 43 and adapted for attaching to the body of the user at the desired position, and a plug 434 provided at the other end of the conductor 431 and adapted for connecting to one jack 44 to receive the low-frequency electric pulse generated by the voltage generators 41.

The power source 50 provides the necessary working voltage to the aforesaid members. According to the present preferred embodiment, the power source 50 is comprised of two mercury cells respectively installed in the battery holders 13 and connected in series.

Referring to FIG. 3, the neuro-fuzzy exerciser instrument panel 1 is installed in the handle 110 of the stationary bicycle 100. When in use, the electrically conductive rubber pads 432 of the massaging devices 43 are respectively attached to, for example, the arms of the user, the switches 16 and 17 are operated to switch on the stationary bicycle 100 and the massager unit 40, and the control buttons 15 are operated to set the desired operation mode. When the user steps on the pedals 120, a low-frequency electric pulse is transmitted to the body of the user to stimulate the muscles of the arms.

Of course, the user can operate the massager unit 40 to stimulate the muscles of any part of the body before riding the stationary bicycle 100, or after an exercise. The application of the low-frequency electric pulse stimulates the circulation of blood, reducing possible accumulation of lactate in the muscles or joints.

As indicated above, the invention achieves the following advantages:

1. Body warm-up before exercise: Before using the exerciser, the user can operate the massager unit to simulate the muscles and to warm up the body, so as to prevent the chance of an athletic injury.

2. Whole body exercising effect: When operating the exerciser to exercise the body, the massager unit is operated to relax the muscles of different parts of the body and to simultaneously stimulate the circulation of blood.

3. Muscle relaxation effect after exercise: After an exercise, the user can operate the massager unit again to relax the muscles of the body.

Figure 4:
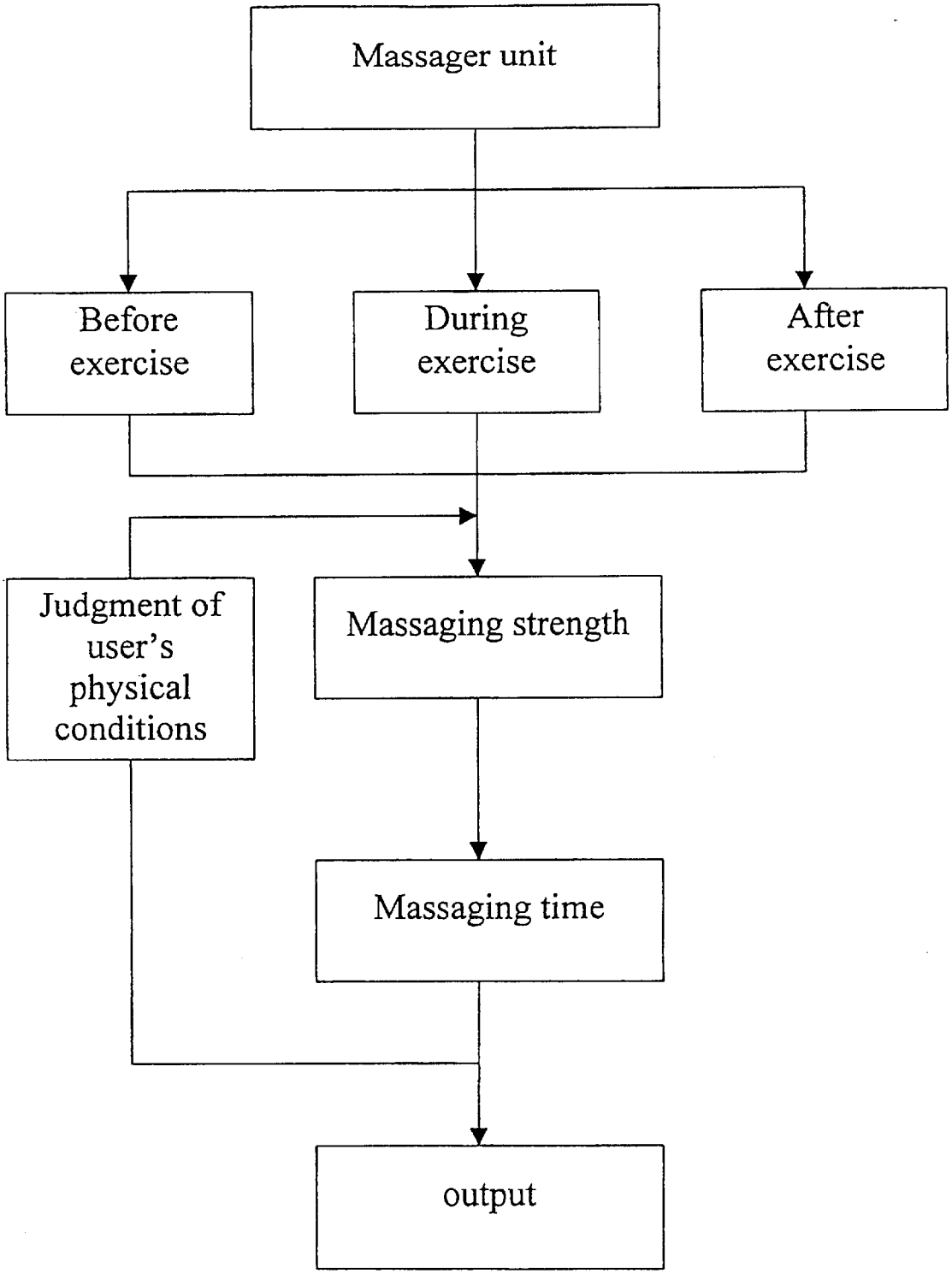
FIG. 4 is a relaxation operation flow chart according to the present invention.

4. Neuro-fuzzy relaxation massaging effect. The control circuit of the neuro-fuzzy exerciser instrument panel controls the operation of the massager unit before, during or after exercise, subject to the feedback data of the physical conditions (blood pressure, heart beat, body fat) of the user measured by the neuro-fuzzy exerciser instrument panel (the flow chart is shown in FIG. 4).

While only one embodiment of the present invention has been shown and described, it will be understood that various modifications and changes could be made thereunto without departing from the spirit and scope of the invention disclosed. For example, the number of the massaging devices 43 of the massager unit 40 can be increased for attaching to different parts (the arms, the legs, the neck, the back, etc. of the body), and the neuro-fuzzy exerciser instrument panel 1 can be used with any of a variety of exercising apparatus such as rowing machine, stepping exerciser, weight-lifting machine, running exerciser, waist training machine, and etc.

What the invention claimed is:

1. A neuro-fuzzy exerciser instrument panel of the type comprising a housing installed in an exerciser; a main control circuit installed in said housing; and a set of control buttons mounted on said housing for signal input to said control circuit to control the operation of the exerciser in which said housing is installed; the neuro-fuzzy exerciser instrument panel further comprising:

a massager unit, said massager unit comprising energy generating means adapted to generate an energy for stimulating the muscles of the user, and at least one massaging device adapted to transmit the energy from said energy generating means to a part of the body of the user;

switch means mounted on said housing and adapted to switch on/off said massager unit; and power source means adapted to provide the necessary working voltage to said main control circuit and said massager unit.

2. The neuro-fuzzy exerciser instrument panel of claim 1, wherein said energy generating means of said massager unit is controlled to generate a low-voltage electric pulse.

3. The neuro-fuzzy exerciser instrument panel of claim 1, wherein said energy generating means of said massager unit comprises at least one voltage generator controlled to generate a low-voltage electric pulse, and at least one pulse control circuit adapted to control the intensity and circulation mode of the low-voltage electric pulse generated by said at least one voltage generator.

4. The neuro-fuzzy exerciser instrument panel of claim 2, wherein said at least one massaging device of said massager unit each comprises a conductor connected to said energy generating means, and an electrically conductive rubber pad connected to one end of said conductor and adapted for attaching to the body of the user to transmit the low-voltage electric pulse from said energy generating means to the muscles of the body of the user.

5. The neuro-fuzzy exerciser instrument panel of claim 4, wherein said electrically conductive rubber pad is detachably coupled to the periphery of one end of said conductor.

6. The neuro-fuzzy exerciser instrument panel of claim 4, wherein said massager unit further comprises at least one jack respectively mounted on said housing and electrically connected to said energy generating means, and said at least one massaging device of said massager unit each further comprises a plug connected to one end of the respective conductor remote from the respective electrically conductive rubber pad for connection to one of said at one jack to receive the low-voltage electric pulse from said energy generating means.

7. The neuro-fuzzy exerciser instrument panel of claim 1 further comprising a plurality of control buttons adapted to control said at least one pulse control circuit in controlling the intensity and circulation mode of the low-voltage electric pulse generated by said at least one voltage generator.

8. The neuro-fuzzy exerciser instrument panel of claim 1 further comprising a display screen mounted on said housing for display of the operation mode of the exerciser and said massager unit.

* * * * *